US008846165B2

(12) United States Patent
Nito et al.

(10) Patent No.: US 8,846,165 B2
(45) Date of Patent: Sep. 30, 2014

(54) RECORDING MEDIUM

(71) Applicant: Canon Kabushiki Kaisha, Tokyo (JP)

(72) Inventors: Yasuhiro Nito, Inagi (JP); Kazuhiko Araki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/926,826

(22) Filed: Jun. 25, 2013

(65) Prior Publication Data

US 2014/0004282 A1 Jan. 2, 2014

(30) Foreign Application Priority Data

Jun. 28, 2012 (JP) ..... 2012-145660

(51) Int. Cl.
*B41M 5/40* (2006.01)
*B41M 5/52* (2006.01)
*B41M 5/50* (2006.01)

(52) U.S. Cl.
CPC ..... *B41M 5/5218* (2013.01); *B41M 5/52* (2013.01); *B41M 5/506* (2013.01); *B41M 5/5254* (2013.01)
USPC ..... 428/32.24; 428/32.25; 428/32.35

(58) Field of Classification Search
CPC ..... B41M 5/506; B41M 5/52; B41M 5/5218
USPC ..... 428/32.24, 32.25, 32.35
See application file for complete search history.

(56) References Cited

U.S. PATENT DOCUMENTS

2003/0072925 A1* 4/2003 Kiyama et al. ..... 428/195
2011/0135855 A1* 6/2011 Oguri et al. ..... 428/32.25

FOREIGN PATENT DOCUMENTS

JP H07-076162 A 3/1995
JP 2010-030291 A 2/2010

* cited by examiner

*Primary Examiner* — Betelhem Shewareged
(74) *Attorney, Agent, or Firm* — Canon U.S.A., Inc., IP Division

(57) ABSTRACT

A recording medium includes a substrate and at least one ink-receiving layer, wherein an outermost ink-receiving layer of the recording medium contains inorganic particles, particles other than the inorganic particles, and a binder, the particles other than the inorganic particles have an average primary particle size of 30 nm or more and 100 nm or less, the outermost ink-receiving layer of the recording medium has a thickness of 5 μm or more, 60% or more and 90% or less of the particles other than the inorganic particles in the outermost ink-receiving layer of the recording medium are present in a region 500 nm or less below the outermost surface of the recording medium, and the area ratio of a region containing the particles other than the inorganic particles to the outermost surface of the recording medium is 30% or more and 80% or less.

7 Claims, No Drawings

RECORDING MEDIUM

BACKGROUND OF THE INVENTION

1. Field of the Invention

The present invention relates to a recording medium.

2. Description of the Related Art

Japanese Patent Laid-Open Nos. 7-76162 and 2010-30291 disclose a recording medium that includes a porous layer and an outermost layer on a substrate so as to improve ink absorbency and scratch resistance. The porous layer contains alumina, alumina hydrate, dry silica, wet silica, or the like. The outermost layer contains particles of silica gel, colloidal silica, or the like. Japanese Patent Laid-Open No. 7-76162 discloses that a recording medium that includes a porous layer and an outermost layer on a substrate has improved ink absorbency and scratch resistance. The outermost layer contains a silica gel having a size of 10 nm or more and 90 nm or less. Japanese Patent Laid-Open No. 2010-30291 discloses that a recording medium that includes a porous layer and an outermost layer on a substrate has improved ink absorbency. The outermost layer contains spherical colloidal silica particles having a size of 105 nm or more and 200 nm or less.

However, the present inventors found that the recording media according to Japanese Patent Laid-Open No. 7-76162 and No. 2010-30291 sometimes have interference fringes, a phenomenon in which the surface glistens in all the colors of the rainbow. There is also room for improvement in ink absorbency and scratch resistance of the recording medium described in Japanese Patent Laid-Open No. 7-76162. There is also room for improvement in scratch resistance of the recording medium described in Japanese Patent Laid-Open No. 2010-30291, although the recording medium has high ink absorbency.

SUMMARY OF THE INVENTION

The present invention provides a recording medium that has fewer interference fringes and high ink absorbency and scratch resistance.

Such a recording medium can be provided by the present invention. A recording medium according to one aspect of the present invention includes a substrate and at least one ink-receiving layer, wherein an outermost ink-receiving layer of the recording medium contains inorganic particles, particles other than the inorganic particles, and a binder, the particles other than the inorganic particles have an average primary particle size of 30 nm or more and 100 nm or less, the outermost ink-receiving layer of the recording medium has a thickness of 5 μm or more, 60% or more and 90% or less of the particles other than the inorganic particles in the outermost ink-receiving layer of the recording medium are present in a region 500 nm or less below the outermost surface of the recording medium, and the area ratio of a region containing the particles other than the inorganic particles to the outermost surface of the recording medium is 30% or more and 80% or less.

The present invention can provide a recording medium that has fewer interference fringes and high ink absorbency and scratch resistance.

Further features of the present invention will become apparent from the following description of exemplary embodiments.

DESCRIPTION OF THE EMBODIMENTS

The present invention will be described in detail in the following embodiments.

The present inventors first studied the cause of interference fringes in the recording media described in Japanese Patent Laid-Open No. 7-76162 and No. 2010-30291. The recording media described in Japanese Patent Laid-Open No. 7-76162 and No. 2010-30291 are manufactured by applying a coating liquid for the porous layer to the substrate, drying the coating liquid, and then applying a coating liquid for the outermost layer. Thus, it was found that light waves interfere with each other at the interface between the porous layer and the outermost layer.

The present inventors thought that it is important not to separate the porous layer and the outermost layer and studied the integration of the porous layer and the outermost layer. First, a coating liquid prepared by mixing the materials for the porous layer (including inorganic particles and a binder) and the materials for the outermost layer (including particles having a particular particle size and a binder) was applied to a substrate. Although the occurrence of the interference fringes was reduced, ink absorbency and scratch resistance also deteriorated. This is probably because particles otherwise present on the surface of the recording medium and contributing to scratch resistance are present within the ink-receiving layer, thereby causing a deterioration in scratch resistance, and because the presence of many particles in the ink-receiving layer causes a deterioration in ink absorbency.

The present inventors then studied the integration of the porous layer and the outermost layer while the scratch resistance and ink absorbency functions are separated by placing a region containing many particles having a particular particle size mainly contributing to scratch resistance close to the outermost ink-receiving layer and placing a region containing many inorganic particles mainly contributing to ink absorbency far from the outermost ink-receiving layer. As a result, the present inventors arrived at the present invention. The present invention was found to reduce the occurrence of interference fringes. The present invention was also found to improve ink absorbency and scratch resistance. Although there is no clear reason for this, the present inventors believe the reason as described below.

In general, a plurality of ink-receiving layers have discontinuity in ink absorbency at their interface(s). Thus, absorbed ink may be blocked at the interface(s) because of a difference in ink absorbency between an upper layer and a lower layer. In contrast, an embodiment of the present invention involves no multilayer and does not cause a phenomenon of blocking ink absorption at an interface. Furthermore, a region farther from the outermost ink-receiving layer has higher ink absorbency. This can accelerate ink absorption and improve ink absorbency. Scratch resistance can be improved by strong bonding of particles having a particular particle size and inorganic particles with a binder.

These constituents can synergistically produce their effects to achieve the advantages of the present invention.

[Recording Medium]

A recording medium according to an embodiment of the present invention includes a substrate and at least one ink-receiving layer. A recording medium according to an embodiment of the present invention may be an ink jet recording medium for use in an ink jet recording method. The components of a recording medium according to an embodiment of the present invention will be described below.

<Substrate>

The substrate may be a paper substrate or may include a paper substrate and a polymer layer, for example, a paper substrate coated with a polymer. In an embodiment of the present invention, the substrate may include a paper substrate and a polymer layer. The polymer layer may be disposed on one or both sides of the paper substrate.

The paper substrate is mainly made of wood pulp. If necessary, the paper substrate is made of wood pulp and synthetic pulp, such as polypropylene pulp, or synthetic fibers, such as nylon or polyester fibers. Examples of the wood pulp include, but are not limited to, leaf bleached kraft pulp (LBKP), leaf bleached sulfite pulp (LBSP), needle bleached kraft pulp (NBKP), needle bleached sulfite pulp (NBSP), leaf dissolving pulp (LDP), needle dissolving pulp (NDP), leaf unbleached kraft pulp (LUKP), and needle unbleached kraft pulp (NUKP). These may be used alone or in combination. The wood pulp may be LBKP, NBSP, LBSP, NDP, or LDP, which contains a large amount of short fiber component. The pulp may be chemical pulp (sulfate pulp or sulfite pulp) containing less impurities. The pulp may be bleached to increase the degree of whiteness. The paper substrate may contain a sizing agent, a white pigment, a paper strengthening agent, a fluorescent brightener, a water-retaining agent, a dispersant, and/or a softening agent.

In an embodiment of the present invention, the paper substrate preferably has a density of 0.6 g/cm$^3$ or more and 1.2 g/cm$^3$ or less, more preferably 0.7 g/cm$^3$ or more and 1.2 g/cm$^3$ or less, in accordance with JIS P 8118.

In an embodiment of the present invention, the polymer layer on the substrate may have a thickness of 20 μm or more and 60 μm or less. In an embodiment of the present invention, the thickness of the polymer layer is calculated by the following method. First, a recording medium is cut with a microtome, and the cross section is observed with a scanning electron microscope. The thickness measurements at 100 or more points are averaged to determine the thickness of the polymer layer. The thickness of another layer in an embodiment of the present invention is also determined in the same manner.

The polymer layers on both sides of the paper substrate may have the thickness described above. The polymer layer may be made of a thermoplastic polymer. Examples of the thermoplastic polymer include, but are not limited to, acrylic polymers, acrylic silicone polymers, polyolefin polymers, and styrene-butadiene copolymers. Among these, the thermoplastic polymer may be a polyolefin polymer. The term "polyolefin polymer", as used herein, refers to a polymer of an olefin monomer. More specifically, the polyolefin polymer may be a homopolymer or a copolymer of ethylene, propylene, and/or isobutylene. These polyolefin polymers may be used alone or in combination. Among these, the polyolefin polymer may be polyethylene. The polyethylene may be a low-density polyethylene (LDPE) or a high-density polyethylene (HDPE). The polymer layer may contain a white pigment, a fluorescent brightener, and/or an ultramarine blue pigment to control its opacity, degree of whiteness, or hue. In particular, the polymer layer may contain a white pigment to improve its opacity. Examples of the white pigment include, but are not limited to, rutile and anatase titanium oxides.

<Ink-Receiving Layer>

In an embodiment of the present invention, the ink-receiving layer may be disposed on one or both sides of the substrate. In an embodiment of the present invention, the ink-receiving layer may be disposed on both sides of the substrate. The ink-receiving layer on one side of the substrate may have a thickness of 30 μm or more and 45 μm or less.

In an embodiment of the present invention, the ink-receiving layer may be a monolayer or a multilayer. The outermost ink-receiving layer of a recording medium is hereinafter referred to as "the outermost surface layer". A layer of a multilayer ink-receiving layer other than the outermost surface layer is hereinafter referred to as an "intermediate layer". An additional layer may be disposed on the outermost surface layer without losing the advantages of the present invention. Materials for the ink-receiving layer will be described below.

Outermost Surface Layer

In an embodiment of the present invention, the outermost surface layer has a thickness of 5 μm or more. The outermost surface layer may have a thickness of 15 μm or less. The outermost surface layer contains inorganic particles, particles having an average primary particle size of 30 nm or more and 100 nm or less, and a binder.

(1) Inorganic Particles

In an embodiment of the present invention, the outermost surface layer of the ink-receiving layer contains inorganic particles. The inorganic particles preferably have an average primary particle size of 50 nm or less, more preferably 1 nm or more and 30 nm or less, particularly preferably 3 nm or more and 10 nm or less. In an embodiment of the present invention, the average primary particle size of inorganic particles is the number average diameter of circles each having an area equal to the projected area of the corresponding primary particle of the inorganic particles in electron microscope observation. The measurement is performed at 100 or more points.

In an embodiment of the present invention, inorganic particles dispersed using a dispersant may be used in a coating liquid for the ink-receiving layer. The dispersed inorganic particles preferably has an average secondary particle size of 0.1 nm or more and 500 nm or less, more preferably 1.0 nm or more and 300 nm or less, particularly preferably 10 nm or more and 250 nm or less. The average secondary particle size of dispersed inorganic particles can be measured by a dynamic light scattering method.

In an embodiment of the present invention, the inorganic particle content (% by mass) of the ink-receiving layer is preferably 50% by mass or more and 98% by mass or less, more preferably 70% by mass or more and 96% by mass or less.

In an embodiment of the present invention, the coating weight (g/m) of the inorganic particles in the formation of the ink-receiving layer may be 8 g/m$^2$ or more and 45 g/m$^2$ or less. Within this range, the ink-receiving layer may have a desired film thickness.

Examples of the inorganic particles for use in an embodiment of the present invention include, but are not limited to, alumina hydrate, alumina, silica, colloidal silica, titanium dioxide, zeolite, kaolin, talc, hydrotalcite, zinc oxide, zinc hydroxide, aluminum silicate, calcium silicate, magnesium silicate, zirconium oxide, and zirconium hydroxide particles. These inorganic particles may be used alone or in combination. Among these inorganic particles, alumina hydrate, alumina, and silica particles can form a porous structure having high ink absorbency.

Alumina hydrate for use in the ink-receiving layer may have a general formula (X): $Al_2O_{3-n}(OH)_{2n}.mH_2O$ (wherein n denotes 0, 1, 2, or 3, and m denotes 0 or more and 10 or less, preferably 0 or more and 5 or less, provided that m or n is not 0). In many instances, $mH_2O$ means a detachable aqueous phase not involved in the formation of a crystal lattice, and therefore m may not be an integer. When alumina hydrate is heated, m may be 0.

In an embodiment of the present invention, alumina hydrate may be produced by a known method. More specifically, alumina hydrate may be produced by hydrolyzing an aluminum alkoxide, hydrolyzing sodium aluminate, or neutralizing an aqueous sodium aluminate solution with an aqueous aluminum sulfate or aluminum chloride solution.

It is known that alumina hydrate has a crystal structure of amorphous, gibbsite, or boehmite, depending on the heat treatment temperature. The crystal structure of alumina hydrate can be analyzed by an X-ray diffraction method. In an embodiment of the present invention, among these, alumina hydrate having a boehmite structure or amorphous alumina hydrate may be used. Specific examples of alumina hydrate include, but are not limited to, alumina hydrates described in Japanese Patent Laid-Open No. 7-232473, No. 8-132731, No. 9-66664, and No. 9-76628 and commercial products Disperal HP14 and HP18 (manufactured by Sasol). These alumina hydrates may be used alone or in combination.

In an embodiment of the present invention, alumina hydrate preferably has a BET specific surface area of 100 $m^2/g$ or more and 200 $m^2/g$ or less, more preferably 125 $m^2/g$ or more and 190 $m^2/g$ or less. The BET specific surface area is determined from the number of molecules or ions having a known size adsorbed on the surface of a sample. In an embodiment of the present invention, a gas to be adsorbed on the surface of a sample is nitrogen gas.

Alumina hydrate may be flakes. The average aspect ratio of the average primary particle size to the average particle thickness of alumina hydrate flakes may be 3.0 or more and 10 or less. The average particle thickness is the number average thickness of 10 alumina hydrate flakes in electron microscope observation. The ratio of the minimum particle size to the maximum particle size of alumina hydrate flakes may be 0.60 or more and 1.0 or less.

Alumina for use in the ink-receiving layer may be gas-phase alumina. Examples of the gas-phase alumina include, but are not limited to, γ-alumina, α-alumina, δ-alumina, θ-alumina, and χ-alumina. Among these, γ-alumina can provide high image optical density and ink absorbency. Specific examples of the gas-phase alumina include, but are not limited to, Aeroxide Alu C, Alu 130, and Alu 65 (manufactured by Evonik Industries AG.).

In an embodiment of the present invention, the gas-phase alumina preferably has a BET specific surface area of 50 $m^2/g$ or more, more preferably 80 $m^2/g$ or more, and preferably 150 $m^2/g$ or less, more preferably 120 $m^2/g$ or less.

The gas-phase alumina preferably has an average primary particle size of 5 nm or more, more preferably 11 nm or more, and preferably 30 nm or less, more preferably 15 nm or less.

Alumina hydrate and alumina for use in an embodiment of the present invention may be mixed in the form of aqueous dispersion with a coating liquid for the ink-receiving layer using an acid dispersant. The acid dispersant may be a sulfonic acid having a general formula (Y): $R—SO_3H$ (wherein R denotes a hydrogen atom, an alkyl group having 1 or more and 4 or less carbon atoms, or an alkenyl group having 1 or more and 4 or less carbon atoms. R may be substituted with an oxo group, a halogen atom, an alkoxy group, and/or an acyl group.). Such a sulfonic acid can suppress blurring of images. In an embodiment of the present invention, the acid content is preferably 1.0% by mass or more and 2.0% by mass or less, more preferably 1.3% by mass or more and 1.6% by mass or less, of the total alumina hydrate and alumina content.

Silica for use in the ink-receiving layer is broadly divided into wet silica and dry (gas-phase) silica in accordance with its production method. In accordance with one known wet process, a silicate is decomposed with an acid to form activated silica, and the activated silica is subjected to polymerization, coagulation, and sedimentation to yield hydrous silica. In accordance with one known dry process (gas-phase process), anhydrous silica is produced by high-temperature gas phase hydrolysis (flame hydrolysis) of a silicon halide or thermal reduction and vaporization of silica sand and coke with an arc in an electric furnace and oxidization with air (an arc process). In an embodiment of the present invention, silica produced by a dry process (gas-phase process) (hereinafter referred to also as "gas-phase silica") may be used. Gas-phase silica has a particularly large specific surface area, particularly high ink absorbency, and a low refractive index. Thus, gas-phase silica can impart transparency and high color developability to the ink-receiving layer. Specific examples of the gas-phase silica include, but are not limited to, Aerosil (manufactured by Nippon Aerosil Co., Ltd.) and Reolosil QS (manufactured by Tokuyama Corp.).

In an embodiment of the present invention, the gas-phase silica preferably has a BET specific surface area of 50 $m^2/g$ or more and 400 $m^2/g$ or less, more preferably 200 $m^2/g$ or more and 350 $m^2/g$ or less.

In an embodiment of the present invention, gas-phase silica dispersed using a dispersant may be used in a coating liquid for the ink-receiving layer. The dispersed gas-phase silica may have a particle size of 50 nm or more and 300 nm or less. The particle size of dispersed gas-phase silica can be measured by a dynamic light scattering method.

In an embodiment of the present invention, alumina hydrate, alumina, and silica may be used in combination. More specifically, at least two selected from alumina hydrate, alumina, and silica powders may be mixed and dispersed to produce a dispersion liquid. In an embodiment of the present invention, the inorganic particles may be alumina hydrate and gas-phase alumina. The ratio of the alumina hydrate content (% by mass) to the gas-phase alumina content (% by mass) in the outermost surface layer of the ink-receiving layer may be 60/40 or more and 90/10 or less, that is, 1.5 or more and 9.0 or less.

(2) Binder

In an embodiment of the present invention, the outermost surface layer of the ink-receiving layer contains a binder. The term "binder", as used herein, refers to a material that can bind inorganic particles together to form a film.

In an embodiment of the present invention, the binder content of the ink-receiving layer may be 7% by mass or more and 25% by mass or less of the inorganic particle content in terms of ink absorbency.

Examples of the binder include, but are not limited to, starch derivatives, such as oxidized starch, etherified starch, and phosphorylated starch; cellulose derivatives, such as carboxymethylcellulose and hydroxyethylcellulose; casein, gelatin, soybean protein, poly(vinyl alcohol), and derivatives thereof; latexes of conjugated polymers, such as polyvinylpyrrolidone, maleic anhydride polymers, styrene-butadiene copolymers, and methyl methacrylate-butadiene copolymers; latexes of acrylic polymers, such as acrylate and methacrylate polymers; latexes of vinyl polymers, such as ethylene-vinyl acetate copolymers; latexes of functional-group-modified polymers, such as the polymers described above modified with a monomer having a functional group, such as a carboxy group; the polymers described above cationized using a cation group; the polymers described above having a surface cationized using a cation surfactant; the polymers described above having a surface on which cationic poly(vinyl alcohol) is distributed by the polymerization of monomers constituting the polymers in the presence of the cationic poly(vinyl alcohol); the polymers described above having a surface on which cationic colloidal particles are distributed by the polymerization of monomers constituting the polymers in a suspension of the cationic colloidal particles; aqueous binders, such as thermosetting synthetic polymers, such as melamine polymers and urea polymers; polymers and copolymers of acrylates and methacrylates, such as poly(methyl methacrylate); and synthetic polymers, such as polyurethane polymers, unsaturated polyester polymers, vinyl chloride-vinyl acetate copolymers, poly(vinyl butyral), and alkyd polymers. These binders may be used alone or in combination.

Among these binders, poly(vinyl alcohol) and poly(vinyl alcohol) derivatives may be used. Examples of the poly(vinyl alcohol) derivatives include, but are not limited to, cation-modified poly(vinyl alcohol), anion-modified poly(vinyl alcohol), silanol-modified poly(vinyl alcohol), and poly(vinyl acetal). The cation-modified poly(vinyl alcohol) may be poly(vinyl alcohol) having a primary, secondary, or tertiary amino group or a quaternary ammonium group in its main chain or side chain, as described in Japanese Patent Laid-Open No. 61-10483.

Poly(vinyl alcohol) may be synthesized by saponification of poly(vinyl acetate). The degree of saponification of poly (vinyl alcohol) is preferably 80% by mole or more and 100% by mole or less, more preferably 85% by mole or more and 98% by mole or less. The degree of saponification is the rate of the number of moles of hydroxy groups produced by saponification of poly(vinyl acetate) to produce poly(vinyl alcohol). In an embodiment of the present invention, the degree of saponification is determined in accordance with JIS K 6726. Poly(vinyl alcohol) preferably has an average degree of polymerization of 1,500 or more, more preferably 2,000 or more and 5,000 or less. In an embodiment of the present invention, the average degree of polymerization is a viscosity-average degree of polymerization determined in accordance with JIS K 6726.

A coating liquid for the outermost surface layer may be prepared using an aqueous poly(vinyl alcohol) or poly(vinyl alcohol) derivative solution. The solid content of the aqueous poly(vinyl alcohol) or poly(vinyl alcohol) derivative solution may be 3% by mass or more and 10% by mass or less.

(3) Particles Having Average Primary Particle Size of 30 nm or More and 100 nm or Less In an embodiment of the present invention, the outermost surface layer contains particles having an average primary particle size of 30 nm or more and 100 nm or less (hereinafter also referred to simply as "particles"). The average primary particle size is preferably 45 nm or more and 80 nm or less. When the particles have an average primary particle size of less than 30 nm, the particles may be densely packed, resulting in low ink absorbency. When the particles have an average primary particle size of more than 100 nm, the particles may be weakly bonded together, resulting in low scratch resistance. The average primary particle size is determined by observing a surface of a recording medium with a scanning electron microscope at a magnification of 50,000, choosing 100 particles on the surface, measuring their particle sizes, and calculating the number average.

60% or more and 90% or less of the particles in the outermost surface layer are present in a region satisfying $d \leq 500$ nm, wherein d denotes the depth from the outermost surface of the recording medium. In other words, 10% or more and 40% or less of the particles in the outermost surface layer are present in a region satisfying $d > 500$ nm. Such a structure can reduce the occurrence of interference fringes and improve ink absorbency and scratch resistance. In an embodiment of the present invention, the particle content distribution in the depth direction is measured by the following method. First, a recording medium is cut with a microtome, and the cross section is observed with a scanning electron microscope at a magnification of 50,000. The numbers of particles in a region A satisfying $d \leq 500$ nm and a region B satisfying $d > 500$ nm in the resulting image are counted. The number of particles in the region A is divided by the number of particles in the entire region (region A+region B) to calculate the rate of particles present in the region 500 nm or less below the outermost surface of the recording medium.

A method for forming the outermost surface layer having the particle content distribution described above in the depth direction will be specifically described below. A first method involves applying a coating liquid not containing particles having an average primary particle size of 30 nm or more and 100 nm or less and, without drying, applying a coating liquid containing particles having an average primary particle size of 30 nm or more and 100 nm or less (a wet-on-wet method). Another wet-on-wet method involves simultaneously applying a coating liquid not containing particles having an average primary particle size of 30 nm or more and 100 nm or less and a coating liquid containing particles having an average primary particle size of 30 nm or more and 100 nm or less. The coating weights of the coating liquids and the numbers of particles having an average primary particle size of 30 nm or more and 100 nm or less in the coating liquids are appropriately controlled such that the outermost surface layer has the particle content distribution described above in the depth direction. A second method involves applying a coating liquid containing particles having an average primary particle size of 30 nm or more and 100 nm or less and inorganic particles having a higher specific gravity than the particles having an average primary particle size of 30 nm or more and 100 nm or less. In accordance with the second method, a region far from the outermost layer contains a large number of inorganic particles having a high specific gravity, and a region close to the outermost layer contains a large number of particles having a small specific gravity. These specific gravities are appropriately controlled such that the outermost surface layer has the particle content distribution described above in the depth direction.

In an embodiment of the present invention, the area ratio of a region containing the particles to the outermost surface of the recording medium is 30% or more and 80% or less, preferably 35% or more and 70% or less, more preferably 40% or more and 70% or less. An area ratio of less than 30% may result in low scratch resistance even when the particle content distribution in the depth direction is satisfied. An area ratio of more than 80% may result in low ink absorbency. In an embodiment of the present invention, the area ratio is measured by the following method. First, a surface of a recording medium is observed with a scanning electron microscope at a magnification of 50,000. The number of particles in the observation field is counted. The area of a region containing the particles is calculated using a formula $(\text{average primary particle size}/2)^2 \times \text{number of particles} \times \pi$ from the average primary particle size thus obtained. The area of the region containing the particles is divided by the observation field area to determine the area ratio of the region containing the particles to the outermost surface of the recording medium.

The particles are preferably substantially spherical, particularly preferably spherical. The particles have the same surface charges as the inorganic particles or are nonionic.

The particles may be colloidal silica or polymer particles. In an embodiment of the present invention, colloidal silica may be used. The colloidal silica may be cationized. Specific examples of colloidal silica include, but are not limited to, Cartacoat K303C (manufactured by Clariant AG), Snowtex AKL and MP1040 (manufactured by Nissan Chemical Industries, Ltd.), and colloidal silica PL-3 (manufactured by Fuso Chemical Co., Ltd.). Examples of the polymer particles include, but are not limited to, polyamide polymer, polyester polymer, polycarbonate polymer, polyolefin polymer, polysulfone polymer, polystyrene polymer, poly(vinyl chloride) polymer, poly(vinylidene chloride) polymer, poly(phenylene sulfide) polymer, ionomer polymer, acrylic polymer, vinyl polymer, urea polymer, melamine polymer, urethane polymer, nylon, cellulose compound, and starch particles. Among these, polyolefin polymer particles may be used.

(4) Cross-linker

In an embodiment of the present invention, the outermost surface layer of the ink-receiving layer may further contain a cross-linker. Examples of the cross-linker include, but are not limited to, aldehyde compounds, melamine compounds, isocyanate compounds, zirconium compounds, amide compounds, aluminum compounds, boric acids, and borates. These cross-linkers may be used alone or in combination. In particular, when the binder is poly(vinyl alcohol) or a poly (vinyl alcohol) derivative, among these cross-linkers, boric acid or a borate may be used.

Examples of boric acids include, but are not limited to, orthoboric acid ($H_3BO_3$), metaboric acid, and hypoboric acid. Borates may be water-soluble salts of these boric acids. Examples of such borates include, but are not limited to, alkali metal salts of boric acid, such as sodium borate and potassium borate, alkaline-earth metal salts of boric acid, such as magnesium borate and calcium borate, and ammonium salts of boric acid. Among these, orthoboric acid can improve the temporal stability of a coating liquid and reduce the occurrence of cracks.

The amount of cross-linker used depends on the manufacturing conditions. In an embodiment of the present invention, the cross-linker content of the outermost surface layer is preferably 1.0% by mass or more and 50% by mass or less, more preferably 5% by mass or more and 40% by mass or less, of the binder content.

When the binder is poly(vinyl alcohol) and when the cross-linker is at least one selected from boric acids and borates, the total boric acid and borate content may be 10% by mass or more and 15% by mass or less of the poly(vinyl alcohol) content of the outermost surface layer.

(5) Other Additive Agents

In an embodiment of the present invention, the outermost surface layer of the ink-receiving layer may contain other additive agents. Specific examples of other additive agents include, but are not limited to, a pH-adjusting agent, a thickener, a flow modifier, an antifoaming agent, a foam inhibitor, a surfactant, a mold-release agent, a penetrant, a color pigment, a color dye, a fluorescent brightener, an ultraviolet absorber, an antioxidant, a preservative, a fungicide, a water resistance improver, a dye fixative, a curing agent, and a weatherproofer.

Intermediate Layer

In an embodiment of the present invention, a multilayer ink-receiving layer may include an intermediate layer between a substrate and the outermost surface layer. The intermediate layer may have a thickness of 15 μm or more and 30 μm or less.

In an embodiment of the present invention, the intermediate layer may contain inorganic particles, a binder, and a cross-linker. The inorganic particles, the binder, and the cross-linker of the intermediate layer may be those for use in the outermost surface layer described above.

In an embodiment of the present invention, the cross-linker content of the intermediate layer is preferably 1.0% by mass or more and 50% by mass or less, more preferably 10% by mass or more and 15% by mass or less, of the binder content.

[Method for Manufacturing Recording Medium]

In an embodiment of the present invention, a method for manufacturing a recording medium is not particularly limited and may include a process of preparing a coating liquid for an ink-receiving layer and a process of applying the coating liquid for an ink-receiving layer to a substrate. A method for manufacturing a recording medium will be described below.

<Method for Manufacturing Substrate>

In an embodiment of the present invention, a method for manufacturing a paper substrate may be a common paper-making method. Examples of a paper-making apparatus include, but are not limited to, a Fourdrinier machine, a cylinder machine, a drum paper machine, and a twin-wire former. In order to improve the surface smoothness of a paper substrate, heat and pressure may be applied to the paper substrate to perform surface treatment during or after the paper-making process. A specific surface treatment method may be calendering, such as machine calendering or super-calendering.

A method for forming a polymer layer on a paper substrate or a method for coating a paper substrate with a polymer may be a melt extrusion process, wet lamination, or dry lamination. In the melt extrusion process, one or both sides of a paper substrate may be coated with molten polymer by extrusion coating. For example, a transported paper substrate and a polymer from an extrusion die are pressed between a nip roller and a cooling roller to form a polymer layer on the paper substrate (also referred to as an extrusion coating process). The extrusion coating process is widely employed. In the formation of a polymer layer by the melt extrusion process, pretreatment may be performed to improve adhesion between a paper substrate and the polymer layer. The pretreatment may be acid etching using a mixture of sulfuric acid and chromic acid, flame treatment using gas flame, ultraviolet irradiation treatment, corona discharge treatment, glow discharge treatment, or anchor coating treatment using an alkyl titanate. Among these, corona discharge treatment may be used.

<Method for Forming Ink-Receiving Layer>

An ink-receiving layer of a recording medium according to an embodiment of the present invention may be formed on a substrate by the following method. First, a coating liquid for the ink-receiving layer is prepared. The coating liquid is applied to the substrate and is dried to produce a recording medium according to an embodiment of the present invention. The coating liquid may be applied with a curtain coater, an extrusion coater, or a slide hopper coater. The coating liquid may be heated during the application. The coating liquid may be dried using a hot-air dryer, such as a linear tunnel dryer, an arch dryer, an air loop dryer, or a sine-curve air float dryer, or an infrared, heating, or microwave dryer.

EXAMPLES

The present invention will be further described in the following examples and comparative examples. However, the present invention is not limited to these examples. Unless otherwise specified, "part" in the following examples is based on mass.

[Manufacture of Recording Medium]

<Manufacture of Substrate>

Water was added to a mixture of 80 parts of LBKP having a Canadian Standard freeness of 450 mL CSF, 20 parts of NBKP having a Canadian Standard freeness of 480 mL CSF, 0.60 parts of cationized starch, 10 parts of heavy calcium carbonate, 15 parts of light calcium carbonate, 0.10 parts of an alkyl ketene dimer, and 0.030 parts of cationic polyacrylamide such that the solid content was 3.0% by mass to prepare stuff. The stuff was then subjected to a Fourdrinier machine and a three-stage wet press and was dried with a multi-cylinder dryer. The resulting paper was impregnated with an aqueous solution of oxidized starch using a size press machine such that the solid content after drying was 1.0 g/m$^2$. After drying, the paper was subjected to machine calendering to produce a paper substrate. The paper substrate had a basis weight of 170 g/m$^2$, a Stockigt sizing degree of 100 seconds, an air permeability of 50 seconds, a Bekk smoothness of 30 seconds, a Gurley stiffness of 11.0 mN, and a thickness of 100 μm. A polymer composition composed of 70 parts of a low-density polyethylene, 20 parts of a high-density polyethylene, and 10 parts of titanium oxide was then applied to one side of the paper substrate such that the dry coating weight was 25 g/m$^2$. This side of the paper substrate is a front surface of the substrate. A low-density polyethylene was applied to the other side of the paper substrate to complete the substrate.

<Preparation of Inorganic Particle Dispersion>

Preparation of Inorganic Particle Dispersion 1

40.0 g of alumina hydrate Disperal HP14 (manufactured by Sasol) and 0.6 g of methanesulfonic acid were added to 160.0 g of pure water. Stirring the mixture with a mixer for 30 minutes yielded an inorganic particle dispersion 1 containing alumina hydrate particles as inorganic particles (the solid content was 20.0% by mass). The alumina hydrate particles in the inorganic particle dispersion 1 had an average primary particle size of 130 nm and a true specific gravity of approximately 4.

Preparation of Inorganic Particle Dispersion 2

40.0 g of gas-phase alumina Aeroxide AluC (manufactured by Evonik Industries AG) and 0.5 g of methanesulfonic acid were added to 160.0 g of pure water. Stirring the mixture with a mixer for 30 minutes yielded an inorganic particle dispersion 2 containing gas-phase alumina particles as inorganic particles (the solid content was 20.0% by mass). The gas-phase alumina particles in the inorganic particle dispersion 2 had an average primary particle size of 160 nm and a true specific gravity of approximately 4.

Preparation of Inorganic Particle Dispersion 3

100 g of gas-phase silica Aerosil-A300 (manufactured by Nippon Aerosil Co., Ltd.) and 8 g of cationic polymer Shallol DC-902P (polymer content 50% by mass, average molecular weight 9,000) (manufactured by Daiichi Kogyo Seiyaku Co., Ltd.) were added to 392 g of pure water. Stirring the mixture with a mixer for 30 minutes yielded an inorganic particle dispersion 3 containing gas-phase silica particles as inorganic particles (the solid content was 20.0% by mass). The gas-phase silica particles in the inorganic particle dispersion 3 had an average primary particle size of 150 nm and a true specific gravity of approximately 2.

<Preparation of Particle Dispersion>

Preparation of Particle Dispersion 1

100 g of colloidal silica Cartacoat K303C (manufactured by Clariant AG) was added to 50 g of pure water. Stirring the mixture with a mixer for 30 minutes yielded a particle dispersion 1 containing colloidal silica particles (the solid content was 10.0% by mass). The colloidal silica particles in the particle dispersion 1 had an average primary particle size of 80 nm and a true specific gravity of approximately 2.

Preparation of Particle Dispersion 2

100 g of colloidal silica Snowtex MP1040 (manufactured by Nissan Chemical Industries, Ltd.) was added to 50 g of pure water. Stirring the mixture with a mixer for 30 minutes yielded a particle dispersion 2 containing colloidal silica particles (the solid content was 10% by mass). The colloidal silica particles in the particle dispersion 2 had an average primary particle size of 100 nm and a true specific gravity of approximately 2.

Preparation of Particle Dispersion 3

100 g of colloidal silica Snowtex AKL (manufactured by Nissan Chemical Industries, Ltd.) was added to 50 g of pure water. Stirring the mixture with a mixer for 30 minutes yielded a particle dispersion 3 containing colloidal silica particles (the solid content was 10% by mass). The colloidal silica particles in the particle dispersion 3 had an average primary particle size of 45 nm and a true specific gravity of approximately 2.

Preparation of Particle Dispersion 4

100 g of colloidal silica PL-3 (manufactured by Fuso Chemical Co., Ltd.) was added to 50 g of pure water. Stirring the mixture with a mixer for 30 minutes yielded a particle dispersion 4 containing colloidal silica particles (the solid content was 10% by mass). The colloidal silica particles in the particle dispersion 4 had an average primary particle size of 35 nm and a true specific gravity of approximately 2.

Preparation of Particle Dispersion 5

100 g of colloidal silica PL-7 (manufactured by Fuso Chemical Co., Ltd.) was added to 50 g of pure water. Stirring the mixture with a mixer for 30 minutes yielded a particle dispersion 5 containing colloidal silica particles (the solid content was 10% by mass). The colloidal silica particles in the particle dispersion 5 had an average primary particle size of 120 nm and a true specific gravity of approximately 2.

Preparation of Particle Dispersion 6

100 g of colloidal silica PL-1 (manufactured by Fuso Chemical Co., Ltd.) was added to 50 g of pure water. Stirring the mixture with a mixer for 30 minutes yielded a particle dispersion 6 containing colloidal silica particles (the solid content was 10% by mass). The colloidal silica particles in the particle dispersion 6 had an average primary particle size of 15 nm and a true specific gravity of approximately 2.

Preparation of Particle Dispersion 7

0.5 g of potassium persulfate was mixed with 80 g of pure water and was heated to 80° C. 20 g of styrene monomer was then added dropwise at a rate of 40 g/h while stirring to prepare a particle dispersion 7 containing dispersed polystyrene polymer particles (the solid content was 10.0% by mass). The polystyrene polymer particles in the particle dispersion 7 had an average primary particle size of 80 nm and a true specific gravity of approximately 1.

<Manufacture of Recording Medium>

Manufacture of Recording Media 1 to 27, 33 to 35, and 37

A first coating liquid and a second coating liquid were applied in this order to a substrate prepared as described above using a curtain coater. Table 1 lists the dry coating weights (g/m$^2$) of these coating liquids. The first and second coating liquids were dried with hot air at 100° C. to manufacture a recording medium. The first coating liquid and the second coating liquid were prepared by mixing an inorganic particle dispersion or a particle dispersion prepared as described above, a binder aqueous poly(vinyl alcohol) solution (PVA 235 (manufactured by Kuraray Co., Ltd.) having a degree of polymerization of 3,500 and a degree of saponification of 88% by mole, solid content 8% by mass), and a cross-linker aqueous orthoboric acid solution (solid content 5% by mass) at a solid component ratio listed in Table 1.

Manufacture of Recording Media 28 to 30 and 36

A third coating liquid, a first coating liquid, and a second coating liquid were applied in this order to a substrate prepared as described above using a curtain coater. Table 1 lists the dry coating weights (g/m$^2$) of these coating liquids. These coating liquids were dried with hot air at 100° C. to manufacture a recording medium. The first to third coating liquids were prepared by mixing an inorganic particle dispersion or a particle dispersion prepared as described above, a binder aqueous poly(vinyl alcohol) solution (PVA 235 (manufactured by Kuraray Co., Ltd.) having a degree of polymerization of 3,500 and a degree of saponification of 88% by mole, solid content 8% by mass), and a cross-linker aqueous orthoboric acid solution (solid content 5% by mass) at a solid component ratio listed in Table 1.

Manufacture of Recording Media 31 and 32

A first coating liquid and a second coating liquid were sequentially applied to a substrate prepared as described above using a curtain coater to manufacture a recording medium. Table 1 lists the dry coating weights (g/m$^2$) of these coating liquids. More specifically, the first coating liquid was applied to the substrate and was dried, and the second coating liquid was applied to the substrate and was dried. The coating liquids were dried with hot air at 100° C. The first coating liquid and the second coating liquid were prepared by mixing an inorganic particle dispersion or a particle dispersion prepared as described above, a binder aqueous poly(vinyl alcohol) solution (PVA 235 (manufactured by Kuraray Co., Ltd.) having a degree of polymerization of 3,500 and a degree of saponification of 88% by mole, solid content 8% by mass), and a cross-linker aqueous orthoboric acid solution (solid content 5% by mass) at a solid component ratio listed in Table 1.

TABLE 1

Manufacturing Conditions for Recording Medium

| | First coating liquid | | | | | Second coating liquid | | |
|---|---|---|---|---|---|---|---|---|
| | | | | | | Particle dispersion, Inorganic particle dispersion | | |
| | Inorganic particle dispersion | | Binder | Cross-linker | Coating weight | | Average primary | |
| Recording medium No. | Type | (parts) | (parts) | (parts) | (g/m$^2$) | Type | particle size (nm) | (parts) |
| Recording medium 1 | Inorganic particle dispersion 3 | 100.0 | 20.0 | 4.0 | 35.00 | Particle dispersion 1 | 80 | 100.0 |
| Recording medium 2 | Inorganic particle dispersion 1 | 100.0 | 9.0 | 1.5 | 35.00 | Particle dispersion 1 | 80 | 100.0 |
| Recording medium 3 | Inorganic particle dispersion 1 | 100.0 | 9.0 | 1.5 | 35.00 | Particle dispersion 1 | 80 | 100.0 |
| Recording medium 4 | Inorganic particle dispersion 1 | 100.0 | 9.0 | 1.5 | 35.00 | Particle dispersion 1 | 80 | 100.0 |
| Recording medium 5 | Inorganic particle dispersion 1 | 100.0 | 9.0 | 1.5 | 35.00 | Particle dispersion 1 | 80 | 100.0 |
| Recording medium 6 | Inorganic particle dispersion 1 | 100.0 | 9.0 | 1.5 | 35.00 | Particle dispersion 1 | 80 | 100.0 |
| Recording medium 7 | Inorganic particle dispersion 1 | 100.0 | 9.0 | 1.5 | 35.00 | Particle dispersion 1 | 80 | 100.0 |
| Recording medium 8 | Inorganic particle dispersion 1 | 100.0 | 9.0 | 1.5 | 35.00 | Particle dispersion 1 | 80 | 100.0 |
| Recording medium 9 | Inorganic particle dispersion 1 | 100.0 | 9.0 | 1.5 | 35.00 | Particle dispersion 1 | 80 | 100.0 |
| Recording medium 10 | Inorganic particle dispersion 1 | 100.0 | 9.0 | 1.5 | 35.00 | Particle dispersion 1 | 80 | 100.0 |
| Recording medium 11 | Inorganic particle dispersion 1 | 100.0 | 9.0 | 1.5 | 35.00 | Particle dispersion 1 | 80 | 100.0 |
| Recording medium 12 | Inorganic particle dispersion 1 | 100.0 | 9.0 | 1.5 | 35.00 | Particle dispersion 1 | 80 | 100.0 |
| Recording medium 13 | Inorganic particle dispersion 1 | 100.0 | 9.0 | 1.5 | 35.00 | Particle dispersion 1 | 80 | 100.0 |
| Recording medium 14 | Inorganic particle dispersion 1 | 100.0 | 9.0 | 1.5 | 35.00 | Particle dispersion 1 | 80 | 100.0 |
| Recording medium 15 | Inorganic particle dispersion 1 | 100.0 | 9.0 | 1.5 | 35.00 | Particle dispersion 1 | 80 | 100.0 |
| Recording medium 16 | Inorganic particle dispersion 1 | 100.0 | 9.0 | 1.5 | 35.00 | Particle dispersion 1 | 80 | 100.0 |
| Recording medium 17 | Inorganic particle dispersion 1 | 100.0 | 9.0 | 1.5 | 35.00 | Particle dispersion 1 | 80 | 100.0 |
| Recording medium 18 | Inorganic particle dispersion 1 | 100.0 | 9.0 | 1.5 | 35.00 | Particle dispersion 1 | 80 | 100.0 |
| Recording medium 19 | Inorganic particle dispersion 1 | 100.0 | 9.0 | 1.5 | 35.00 | Particle dispersion 2 | 100 | 100.0 |
| Recording medium 20 | Inorganic particle dispersion 1 | 100.0 | 9.0 | 1.5 | 35.00 | Particle dispersion 3 | 45 | 100.0 |
| Recording medium 21 | Inorganic particle dispersion 1 | 100.0 | 9.0 | 1.5 | 35.00 | Particle dispersion 4 | 35 | 100.0 |
| Recording medium 22 | Inorganic particle dispersion 1 | 100.0 | 9.0 | 1.5 | 35.00 | Particle dispersion 7 | 80 | 100.0 |
| Recording medium 23 | Inorganic particle dispersion 1 | 100.0 | 9.0 | 1.5 | 35.00 | Particle dispersion 1 | 80 | 40.0 |
| | | | | | | Inorganic particle dispersion 1 | 130 | 60.0 |
| Recording medium 24 | Inorganic particle dispersion 1 | 90.0 | 9.0 | 1.5 | 35.00 | Particle dispersion 1 | 80 | 100.0 |
| | Inorganic particle dispersion 2 | 10.0 | | | | | | |
| Recording medium 25 | Inorganic particle dispersion 1 | 80.0 | 9.0 | 1.5 | 35.00 | Particle dispersion 1 | 80 | 100.0 |
| | Inorganic particle dispersion 2 | 20.0 | | | | | | |
| Recording medium 26 | Inorganic particle dispersion 1 | 70.0 | 9.0 | 1.5 | 35.00 | Particle dispersion 1 | 80 | 100.0 |
| | Inorganic particle dispersion 2 | 30.0 | | | | | | |
| Recording medium 27 | Inorganic particle dispersion 1 | 60.0 | 9.0 | 1.5 | 35.00 | Particle dispersion 1 | 80 | 100.0 |
| | Inorganic particle dispersion 2 | 40.0 | | | | | | |
| Recording medium 28 | Inorganic particle dispersion 1 | 80.0 | 9.0 | 1.5 | 35.00 | Particle dispersion 1 | 80 | 100.0 |
| | Inorganic particle dispersion 2 | 20.0 | | | | | | |
| Recording medium 29 | Inorganic particle dispersion 1 | 80.0 | 9.0 | 1.5 | 35.00 | Particle dispersion 1 | 80 | 100.0 |
| | Inorganic particle dispersion 2 | 20.0 | | | | | | |
| Recording medium 30 | Inorganic particle dispersion 1 | 80.0 | 9.0 | 1.5 | 35.00 | Particle dispersion 1 | 80 | 100.0 |
| | Inorganic particle dispersion 2 | 20.0 | | | | | | |
| Recording medium 31 | Inorganic particle dispersion 1 | 100.0 | 9.0 | 1.5 | 35.00 | Particle dispersion 1 | 80 | 100.0 |
| Recording medium 32 | Inorganic particle dispersion 1 | 100.0 | 9.0 | 1.5 | 35.00 | Particle dispersion 1 | 80 | 100.0 |
| Recording medium 33 | Inorganic particle dispersion 1 | 100.0 | 9.0 | 1.5 | 35.00 | Particle dispersion 1 | 80 | 100.0 |
| Recording medium 34 | Inorganic particle dispersion 1 | 100.0 | 9.0 | 1.5 | 35.00 | Particle dispersion 5 | 120 | 100.0 |
| Recording medium 35 | Inorganic particle dispersion 1 | 100.0 | 9.0 | 1.5 | 35.00 | Particle dispersion 6 | 15 | 100.0 |
| Recording medium 36 | Inorganic particle dispersion 1 | 80.0 | 9.0 | 1.5 | 35.00 | Particle dispersion 1 | 80 | 100.0 |
| | Inorganic particle dispersion 2 | 20.0 | | | | | | |
| Recording medium 37 | Inorganic particle dispersion 1 | 100.0 | 9.0 | 1.5 | 35.00 | Particle dispersion 1 | 80 | 100.0 |

TABLE 1-continued

| Manufacturing Conditions for Recording Medium | | | | | | | |
|---|---|---|---|---|---|---|---|
| | Second coating liquid | | | Third coating liquid | | | |
| Recording medium No. | Binder (parts) | Cross-linker (parts) | Coating weight ($g/m^2$) | Inorganic particle dispersion 1 (parts) | Binder (parts) | Cross-linker (parts) | Coating weight ($g/m^2$) |
| Recording medium 1 | 11.0 | 1.2 | 0.30 | — | — | — | — |
| Recording medium 2 | 11.0 | 1.2 | 0.10 | — | — | — | — |
| Recording medium 3 | 11.0 | 1.2 | 0.20 | — | — | — | — |
| Recording medium 4 | 11.0 | 1.2 | 0.30 | — | — | — | — |
| Recording medium 5 | 11.0 | 1.2 | 0.50 | — | — | — | — |
| Recording medium 6 | 11.0 | 1.2 | 2.00 | — | — | — | — |
| Recording medium 7 | 11.0 | 1.2 | 3.00 | — | — | — | — |
| Recording medium 8 | 11.0 | 0 | 0.30 | — | — | — | — |
| Recording medium 9 | 11.0 | 0.5 | 0.30 | — | — | — | — |
| Recording medium 10 | 11.0 | 0.8 | 0.30 | — | — | — | — |
| Recording medium 11 | 11.0 | 1.0 | 0.30 | — | — | — | — |
| Recording medium 12 | 11.0 | 2.0 | 0.30 | — | — | — | — |
| Recording medium 13 | 11.0 | 3.0 | 0.30 | — | — | — | — |
| Recording medium 14 | 0 | 0 | 0.30 | — | — | — | — |
| Recording medium 15 | 5.0 | 0.8 | 0.30 | — | — | — | — |
| Recording medium 16 | 5.0 | 1.2 | 0.30 | — | — | — | — |
| Recording medium 17 | 15.0 | 1.2 | 0.30 | — | — | — | — |
| Recording medium 18 | 20.0 | 1.2 | 0.30 | — | — | — | — |
| Recording medium 19 | 11.0 | 1.2 | 0.30 | — | — | — | — |
| Recording medium 20 | 11.0 | 1.2 | 0.30 | — | — | — | — |
| Recording medium 21 | 11.0 | 1.2 | 0.30 | — | — | — | — |
| Recording medium 22 | 11.0 | 1.2 | 0.30 | — | — | — | — |
| Recording medium 23 | 11.0 | 1.2 | 0.30 | — | — | — | — |
| Recording medium 24 | 11.0 | 1.2 | 0.30 | — | — | — | — |
| Recording medium 25 | 11.0 | 1.2 | 0.30 | — | — | — | — |
| Recording medium 26 | 11.0 | 1.2 | 0.30 | — | — | — | — |
| Recording medium 27 | 11.0 | 1.2 | 0.30 | — | — | — | — |
| Recording medium 28 | 11.0 | 1.2 | 0.30 | 100.0 | 9.0 | 1.5 | 30.00 |
| Recording medium 29 | 11.0 | 1.2 | 0.30 | 100.0 | 9.0 | 1.5 | 25.00 |
| Recording medium 30 | 11.0 | 1.2 | 0.30 | 100.0 | 9.0 | 1.5 | 20.00 |
| Recording medium 31 | 11.0 | 1.2 | 0.30 | — | — | — | — |
| Recording medium 32 | 11.0 | 1.2 | 0.05 | — | — | — | — |
| Recording medium 33 | 11.0 | 1.2 | 4.00 | — | — | — | — |
| Recording medium 34 | 11.0 | 1.2 | 0.30 | — | — | — | — |
| Recording medium 35 | 11.0 | 1.2 | 0.30 | — | — | — | — |
| Recording medium 36 | 11.0 | 1.2 | 0.30 | 100.0 | 9.0 | 1.5 | 32.00 |
| Recording medium 37 | 11.0 | 1.2 | 0.02 | — | — | — | — |

<Characteristics of Ink-Receiving Layer of Recording Medium>

A recording medium was cut with a microtome, and the cross section was observed with a scanning electron microscope SU-70 (manufactured by Hitachi, Ltd.). The thickness of an ink-receiving layer and the particle content distribution of the ink-receiving layer in the depth direction were measured. The surface of the recording medium was observed with the scanning electron microscope SU-70, and the area ratio of a region containing particles to the outermost surface of the recording medium was determined. Table 2 shows the results.

[Rating]

In the following evaluation items, criteria AA to B are acceptable, and criteria C and D are unacceptable. Images were recorded on a recording medium with an ink jet recording apparatus PIXUS MP990 (manufactured by CANON KABUSHIKI KAISHA) equipped with an ink cartridge BCI-321 (manufactured by CANON KABUSHIKI KAISHA). The recording conditions included a temperature of 23° C. and a relative humidity of 50%. A print duty of 100% with respect to the ink jet recording apparatus refers to an image that was recorded under the conditions where approximately 11 ng of one ink droplet was applied to a unit area of 1/600 inches×1/600 inches at a resolution of 600 dpi×600 dpi.

Evaluation of Interference Fringes

Interference fringes were visually checked under a 60-W fluorescent lamp disposed at 30 cm away from a recording medium. The evaluation criteria were described below. Table 2 shows the evaluation results.

A: Interference fringes were not observed.

D: Interference fringes were observed.

Evaluation of Ink Absorbency

Five green solid images having print duties of 150%, 200%, 250%, 300%, and 350% were recorded on a recording medium with the ink jet recording apparatus. Ink absorbency was evaluated by visual inspection of the images for beading. Beading is a phenomenon in which neighboring ink droplets coalesce before being absorbed into a recording medium. Beading is known to be highly correlated with ink absorbency. No beading in an image having a high print duty indicates high ink absorbency. Table 2 shows the evaluation results.

AA: No beading was observed in the image having a print duty of 350%.

A: Although beading was observed in the image having a print duty of 350%, no beading was observed in the image having a print duty of 300%.

B: Although beading was observed in the image having a print duty of 300%, no beading was observed in the image having a print duty of 250%.

C: Although beading was observed in the image having a print duty of 250%, no beading was observed in the image having a print duty of 200%.

D: Beading was observed in the image having a print duty of 200%.

Evaluation of Scratch Resistance

The ink jet recording apparatus was modified such that the conveying roller pressure could be controlled in the range of 2.5 to 3.0 kgf. A black solid image (having a print duty of 100%) was recorded over the entire surface of a recording medium with the ink jet recording apparatus. After recording, the scratch resistance of the recording medium was evaluated by visual inspection of the recording medium for scratches caused by a conveying roller. The evaluation criteria were described below. Table 2 shows the evaluation results.

AA: No scratch was observed at a conveying roller pressure of 3.0 kgf.

A: Although no scratch was observed at a conveying roller pressure of 2.8 kgf, scratches were observed at a conveying roller pressure of 3.0 kgf.

B: Although no scratch was observed at a conveying roller pressure of 2.7 kgf, scratches were observed at a conveying roller pressure of 2.8 kgf.

C: Although no scratch was observed at a conveying roller pressure of 2.5 kgf, scratches were observed at a conveying roller pressure of 2.7 kgf.

D: Scratches were observed at a conveying roller pressure of 2.5 kgf.

Evaluation of Color Developability of Image

A 5 cm×5 cm black solid image (having a print duty of 100%) was recorded on a recording medium with the ink jet recording apparatus in a Photo Paper Gold Glossy fine mode (without color correction). The optical density of the image was measured with a spectrophotometer Spectrolino (manufactured by GretagMacbeth) to evaluate the color developability of the image. The evaluation criteria were described below. Table 2 shows the evaluation results.

AA: The optical density was 2.3 or more.

A: The optical density was 2.2 or more and less than 2.3.

B: The optical density was 2.1 or more and less than 2.2.

C: The optical density was 2.0 or more and less than 2.1.

D: The optical density was less than 2.0.

Evaluation of Glossiness of Recording Medium

The 20-degree glossiness of a recording medium was measured with a glossmeter VG 2000 (manufactured by Nippon Denshoku Industries Co., Ltd.) to evaluate the glossiness of the recording medium. The evaluation criteria were described below. Table 2 shows the evaluation results.

AA: The 20-degree glossiness was 30 or more.

A: The 20-degree glossiness was 27 or more and less than 30.

B: The 20-degree glossiness was 25 or more and less than 27.

C: The 20-degree glossiness was 20 or more and less than 25.

D: The 20-degree glossiness was less than 20.

TABLE 2

Characteristics and Evaluation Results of Recording Medium

| Example No. | Recording medium No. | Thickness of outermost surface layer(μm) | Thickness of ink-receiving layer (μm) | Particle content distribution in depth direction of ink-receiving layer: Content in region 500 nm or less below outermost surface (% by mass) | Particle content distribution in depth direction of ink-receiving layer: Content in region more than 500 nm below outermost surface (% by mass) |
|---|---|---|---|---|---|
| Example 1 | Recording medium 1 | 35 | 35 | 75 | 25 |
| Example 2 | Recording medium 2 | 35 | 35 | 90 | 10 |
| Example 3 | Recording medium 3 | 35 | 35 | 80 | 20 |
| Example 4 | Recording medium 4 | 35 | 35 | 75 | 25 |
| Example 5 | Recording medium 5 | 35 | 35 | 70 | 30 |
| Example 6 | Recording medium 6 | 35 | 35 | 65 | 35 |
| Example 7 | Recording medium 7 | 35 | 35 | 60 | 40 |
| Example 8 | Recording medium 8 | 35 | 35 | 72 | 28 |
| Example 9 | Recording medium 9 | 35 | 35 | 72 | 28 |
| Example 10 | Recording medium 10 | 35 | 35 | 72 | 28 |
| Example 11 | Recording medium 11 | 35 | 35 | 72 | 28 |
| Example 12 | Recording medium 12 | 35 | 35 | 72 | 28 |
| Example 13 | Recording medium 13 | 35 | 35 | 72 | 28 |
| Example 14 | Recording medium 14 | 35 | 35 | 70 | 30 |
| Example 15 | Recording medium 15 | 35 | 35 | 70 | 30 |
| Example 16 | Recording medium 16 | 35 | 35 | 70 | 30 |
| Example 17 | Recording medium 17 | 35 | 35 | 70 | 30 |
| Example 18 | Recording medium 18 | 35 | 35 | 70 | 30 |
| Example 19 | Recording medium 19 | 35 | 35 | 75 | 25 |
| Example 20 | Recording medium 20 | 35 | 35 | 75 | 25 |
| Example 21 | Recording medium 21 | 35 | 35 | 75 | 25 |
| Example 22 | Recording medium 22 | 35 | 35 | 75 | 25 |
| Example 23 | Recording medium 23 | 35 | 35 | 70 | 30 |
| Example 24 | Recording medium 24 | 35 | 35 | 75 | 25 |
| Example 25 | Recording medium 25 | 35 | 35 | 75 | 25 |
| Example 26 | Recording medium 26 | 35 | 35 | 75 | 25 |
| Example 27 | Recording medium 27 | 35 | 35 | 75 | 25 |
| Example 28 | Recording medium 28 | 5 | 35 | 80 | 20 |
| Example 29 | Recording medium 29 | 10 | 35 | 78 | 22 |
| Example 30 | Recording medium 30 | 15 | 35 | 77 | 23 |
| Comparative example 1 | Recording medium 31 | 35 | 35 | 100 | 0 |
| Comparative example 2 | Recording medium 32 | 35 | 35 | 100 | 0 |

TABLE 2-continued

| Characteristics and Evaluation Results of Recording Medium | | | | | |
|---|---|---|---|---|---|
| Comparative example 3 | Recording medium 33 | 35 | 35 | 50 | 50 |
| Comparative example 4 | Recording medium 34 | 35 | 35 | 75 | 25 |
| Comparative example 5 | Recording medium 35 | 35 | 35 | 75 | 25 |
| Comparative example 6 | Recording medium 36 | 3 | 35 | 90 | 10 |
| Comparative example 7 | Recording medium 37 | 35 | 35 | 90 | 10 |

| | Area ratio of region containing particles | Evaluation results | | | | |
|---|---|---|---|---|---|---|
| Example No. | to outermost surface of recording medium (%) | Interference fringes | Ink absorbency | Scratch resistance | Color developability of image | Glossiness of recording medium |
| Example 1 | 35 | A | B | B | AA | A |
| Example 2 | 30 | A | A | B | AA | B |
| Example 3 | 35 | A | A | A | AA | A |
| Example 4 | 40 | A | A | A | AA | AA |
| Example 5 | 45 | A | A | A | AA | AA |
| Example 6 | 70 | A | A | A | AA | AA |
| Example 7 | 80 | A | B | A | AA | AA |
| Example 8 | 38 | A | B | A | AA | AA |
| Example 9 | 38 | A | B | A | AA | AA |
| Example 10 | 38 | A | A | A | AA | AA |
| Example 11 | 38 | A | A | A | AA | AA |
| Example 12 | 38 | A | A | A | AA | AA |
| Example 13 | 38 | A | B | AA | AA | AA |
| Example 14 | 35 | A | B | B | AA | AA |
| Example 15 | 35 | A | A | A | AA | AA |
| Example 16 | 35 | A | A | A | AA | AA |
| Example 17 | 35 | A | A | A | AA | AA |
| Example 18 | 35 | A | B | A | AA | AA |
| Example 19 | 40 | A | A | A | A | A |
| Example 20 | 40 | A | A | A | AA | AA |
| Example 21 | 40 | A | B | A | AA | AA |
| Example 22 | 40 | A | B | B | AA | B |
| Example 23 | 38 | A | A | B | AA | AA |
| Example 24 | 40 | A | A | AA | AA | AA |
| Example 25 | 40 | A | A | AA | AA | AA |
| Example 26 | 40 | A | A | AA | AA | AA |
| Example 27 | 40 | A | A | AA | A | AA |
| Example 28 | 45 | A | AA | AA | AA | AA |
| Example 29 | 43 | A | AA | AA | AA | AA |
| Example 30 | 42 | A | AA | AA | AA | AA |
| Comparative example 1 | 90 | D | D | B | A | AA |
| Comparative example 2 | 45 | D | A | C | A | AA |
| Comparative example 3 | 85 | A | C | A | A | AA |
| Comparative example 4 | 35 | A | A | C | D | C |
| Comparative example 5 | 35 | A | D | B | AA | AA |
| Comparative example 6 | 50 | A | C | C | A | AA |
| Comparative example 7 | 20 | A | A | C | AA | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-145660, filed Jun. 28, 2012, which is hereby incorporated by reference herein in its entirety.

What is claimed is:

1. A recording medium, comprising a substrate and at least one ink-receiving layer, wherein an outermost ink-receiving layer of the recording medium contains inorganic particles, particles other than the inorganic particles, and a binder, the particles other than the inorganic particles have an average primary particle size of 30 nm or more and 100 nm or less, the outermost ink-receiving layer of the recording medium has a thickness of 5 μm or more, 60% or more and 90% or less of the particles other than the inorganic particles in the outermost ink-receiving layer of the recording medium are present in a region 500 nm or less below the outermost surface of the recording medium, and the area ratio of a region containing the particles other than the inorganic particles to the outermost surface of the recording medium is 30% or more and 80% or less.

2. The recording medium according to claim 1, wherein the inorganic particles are at least one selected from alumina, alumina hydrate, gas-phase silica, and wet silica particles, and the particles other than the inorganic particles are at least one selected from colloidal silica and polymer particles.

3. The recording medium according to claim 2, wherein the particles other than the inorganic particles are colloidal silica particles.

4. The recording medium according to claim 2, wherein the inorganic particles are alumina hydrate and gas-phase alumina particles.

5. The recording medium according to claim 4, wherein the ratio of the alumina hydrate content (% by mass) to the gas-phase alumina content (% by mass) in the outermost ink-receiving layer of the recording medium is 1.5 or more and 9.0 or less.

6. The recording medium according to claim 1, further comprising a layer between the substrate and the outermost ink-receiving layer of the recording medium, the layer containing inorganic particles and a binder.

7. The recording medium according to claim 1, manufactured by applying a coating liquid containing the inorganic particles and no particles other than the inorganic particles to the substrate and, without drying, applying a coating liquid containing particles other than the inorganic particles.

* * * * *